US007175577B2

(12) United States Patent
Greenspan et al.

(10) Patent No.: US 7,175,577 B2
(45) Date of Patent: Feb. 13, 2007

(54) THERAPY DEVICE HAVING A ROTATABLY TILTABLE PLATFORM

(75) Inventors: Alexander Greenspan, Novelty, OH (US); Gene Alter, Chagrin Falls, OH (US); Gregory Greenspan, Reminderville, OH (US)

(73) Assignee: Orbital Industries, Inc., Chagrin Falls, OH (US)

( * ) Notice: Subject to any disclaimer, the term of this patent is extended or adjusted under 35 U.S.C. 154(b) by 0 days.

(21) Appl. No.: 10/696,493

(22) Filed: Oct. 29, 2003

(65) Prior Publication Data

US 2004/0142802 A1 Jul. 22, 2004

Related U.S. Application Data

(60) Provisional application No. 60/421,674, filed on Oct. 29, 2002.

(51) Int. Cl.
*A63B 22/14* (2006.01)

(52) U.S. Cl. ..... 482/146; 482/34; 482/79

(58) Field of Classification Search ..... 482/146, 482/34, 79–80, 147; D21/662, 665, 688, D21/698

See application file for complete search history.

(56) References Cited

U.S. PATENT DOCUMENTS 4,290,601 A * 9/1981 Mittelstadt ..... 472/14
4,862,875 A 9/1989 Heaton
4,921,243 A 5/1990 Weidmann
5,145,474 A * 9/1992 Moore ..... 482/51
5,518,476 A * 5/1996 McLeon ..... 482/79
5,593,380 A 1/1997 Bittikofer
5,643,164 A 7/1997 Teff
5,755,652 A 5/1998 Gardner
5,813,958 A 9/1998 Tomita
5,941,807 A * 8/1999 Cassidy et al. ..... 482/146
6,428,451 B1 8/2002 Hall
2003/0199374 A1 * 10/2003 Perry et al. ..... 482/146

* cited by examiner

*Primary Examiner*—Lori Amerson
(74) *Attorney, Agent, or Firm*—Robert H. Earp, III; McDonald Hopkins Co., LPA

(57) ABSTRACT

An exercise device comprising a base and a platform rotatably tiltably connected to the base, wherein the invention includes a first continuous passive motion embodiment and a second continuous active motion embodiment. The continuous passive motion exercise device (e.g. non-motorized) may utilize the nested engagement of a concave surface located in the base and a convex surface extending from the platform to provide a rotatable tiltable connection therebetween. The device may also utilize at least one roller bearing located within the base to assist in permitting the rotatable tiltable motion of the platform relative to the base. The continuous active motion exercise device (e.g. motorized) utilizes a motor housed within the base to drive the rotatably tiltably connected platform.

11 Claims, 13 Drawing Sheets

THERAPY DEVICE HAVING A ROTATABLY TILTABLE PLATFORM

CROSS-REFERENCE TO RELATED APPLICATIONS

This application claims priority from U.S. Provisional Patent Application No. 60/421,674 filed on Oct. 29, 2002, which is hereby incorporated by reference herein.

FIELD OF INVENTION

The present invention relates generally to exercise devices, and in particular, to leg and feet exercise devices for increasing blood circulation in the legs and feet through a rotatably tiltable platform.

BACKGROUND

Many people suffer from pain and discomfort associated with poor blood circulation in the legs. While poor circulation has been associated with increased age and reduced mobility, more and more people are encountering leg circulatory problems at a younger age. Many such circulatory problems are associated with people whose jobs require long periods of sitting or people who exercise on an infrequent basis. Because large numbers of people are increasingly sedentary in their personal lives, have jobs that require sitting for long periods of time, and with a large percentage of the population increasing in age, there is a danger that severe leg circulatory problems will continue to develop at a rapid pace through an ever-increasing portion of the population.

Good circulation through the body and legs can be maintained by regular exercise, in particular, the exercise of walking. During walking, the flexing of the calf muscles act as a "muscle pump" or "blood pump" maintaining good blood circulation in the veins of the legs and especially in the feet. However, walking on a regular basis requires time and a certain amount of commitment. Other constraints further inhibit people from walking on a regular basis, such as weather, temperature, humidity, access to parks or sidewalks, and the current mobility of the exerciser.

Several indoor exercise devices can offer the convenience of exercising in the home, but these devices are often strenuous to operate and expensive to purchase. Further, such devices are not feasible for use while at work or sitting for long periods of time. Often such devices are complex, cumbersome, and expensive.

Therefore, there is a need for a device that exercises the feet and legs that can be used from a seated position. Further, there is a need for a leg exerciser that can be used at home or at work and which is not strenuous to operate.

SUMMARY OF THE INVENTION

In accordance with the present invention there is provided an exercise device comprising a base and a platform rotatably tiltably connected to the base. As such, the present invention may be utilized for either continuous passive motion or continuous active motion.

The continuous passive motion exercise device may utilize the nested engagement of a concave surface located on the top surface of the base and a convex surface extending from the bottom surface of the platform to provide a rotatable tiltable connection therebetween. The device may also utilize at least one roller bearing located within the base to assist in permitting the rotatable tiltable motion of the platform relative to the base. Therefore, the user can use the continuous passive motion exercise device without access to electricity and at any pace desired.

The continuous active motion exercise device utilizes a motor housed within the base to drive the rotatably tiltably connected platform. The platform may utilize a horizontal annular groove located on the inner surface thereof that is engaged by a cam driven by the motor. With the platform mounted to the base at an angle, the cam engages the horizontal groove to rotatably tiltably drive the platform relative to the base. Therefore, the user has to apply little or no effort to maintain the exercise, which means that the user will tend to use the exercise device more diligently than if applied effort were required.

General advantages of the invention are that the walking movement of the foot is carried out including the flexing of the toes and working the calf and shin muscles without the weight of the body on the ankle joints. Further, the ankles may be gently tilted and rotated about 360° to provide increased strength and flexibility as well as increase blood circulation to the legs.

The present invention will be more fully described in the following written description with reference to the accompanying drawings.

DETAILED DESCRIPTION OF THE INVENTION

Reference is now made to the drawings to further describe the present invention. In accordance with the present invention there is provided an exercise device comprising a base and a platform rotatably tiltably connected to the base. The exercise device is preferably used to exercise the feet, ankles, and legs and is preferably used by persons while in the seated position. Therefore, when the feet are placed on the foot-engaging portion of the platform, and the platform is tiltably rotated, the ankles can be flexed evenly in multiple directions. Such ankle flex and rotation permits the calf muscles to flex thereby improving the blood flow circulation in the legs. Further, the present invention may be utilized for either a first embodiment comprising a continuous passive motion exercise device or a second embodiment comprising a continuous active motion exercise device. All embodiments will be described below in detail with reference to the drawings.

The exercise device, according to a first embodiment of the present invention, is shown in FIGS. 1 through 6. The continuous passive motion exercise device, designated 10, generally comprises a base 12 and a platform 14 rotatably tiltably connected to the base 12 for continuous passive motion. Continuous passive motion as used in this description is described as motion imparted on the platform attributed to forces exerted thereon by the user (e.g. non-motorized). Therefore, such an exercise device is operable without a motor or access to electricity or other electrical sources. The device is therefore easily transported for use in any environment and at any pace and any place desired.

Figure 1:
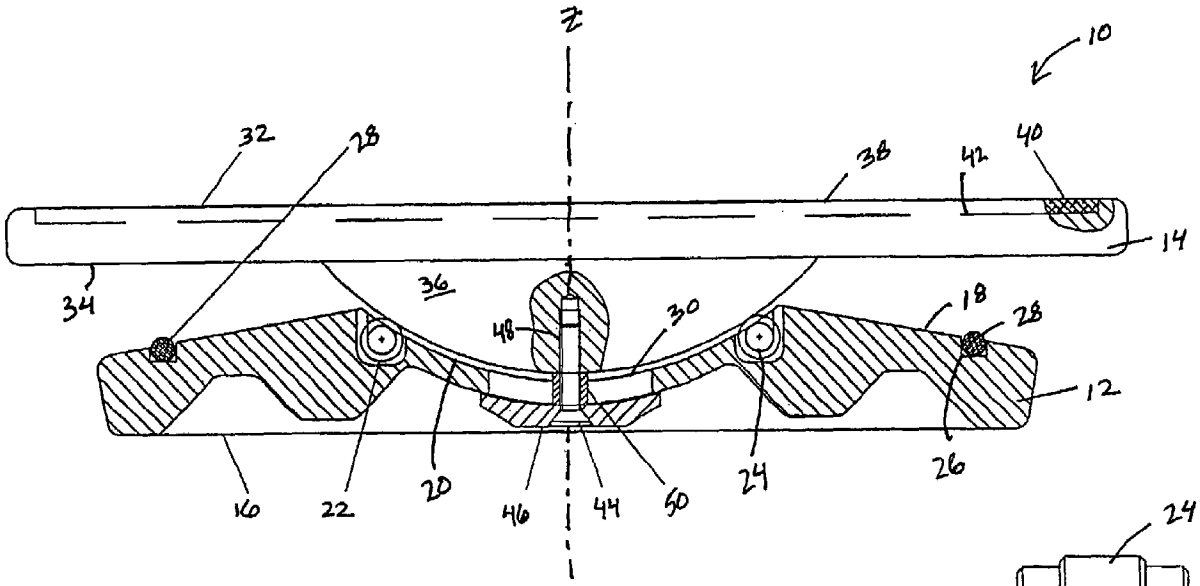
FIG. 1 is a cross-sectional view of a first embodiment of the present invention showing an exercise device for continuous passive motion.
Figure 6:
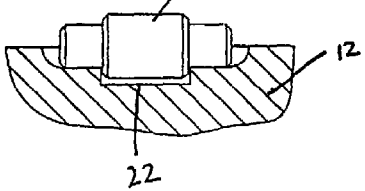
FIG. 6 is a cross-sectional view of a roller bearing taken along line A—A of FIG. 1.
Figure 5:
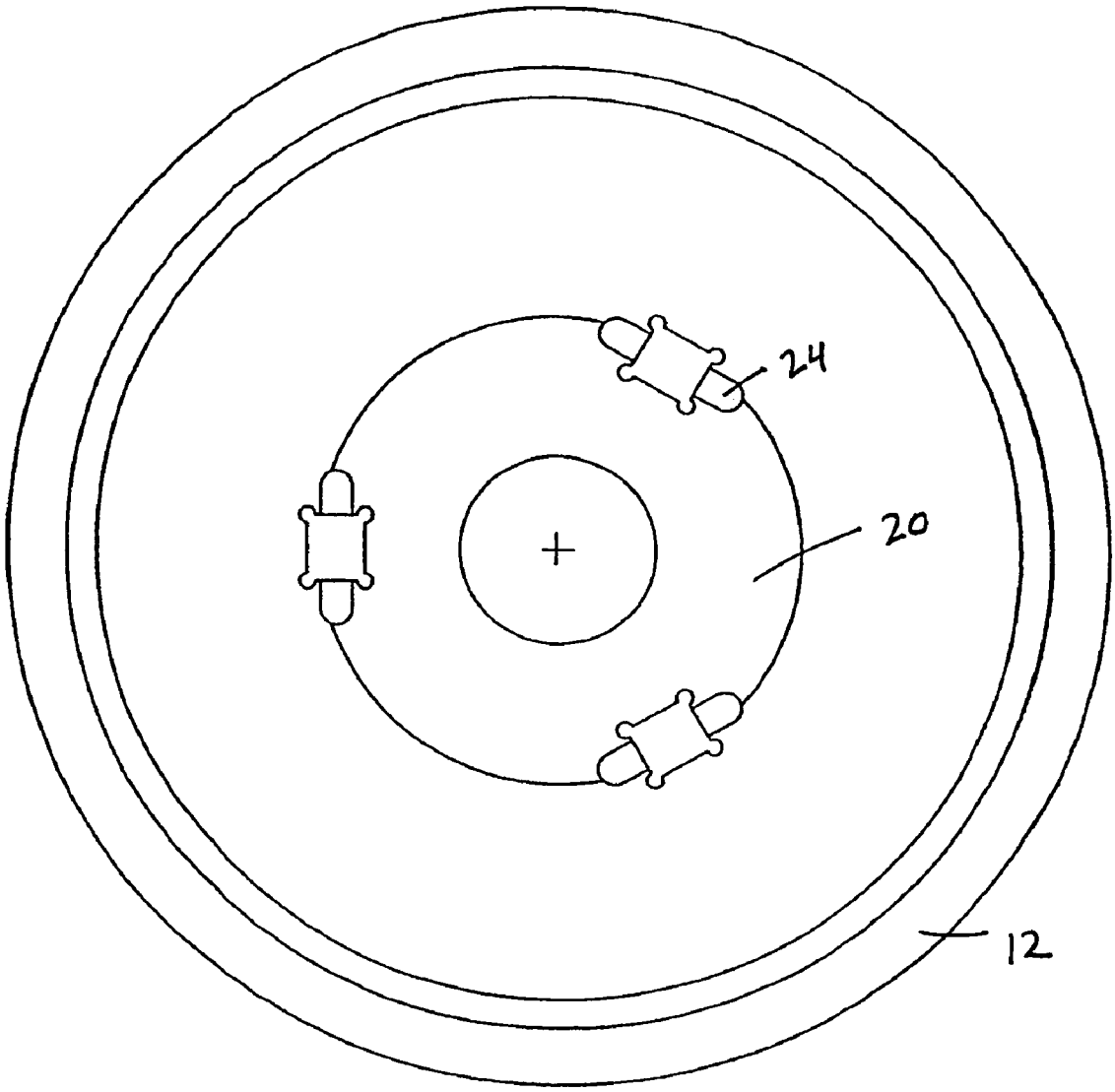
FIG. 5 is a top plan view of the exercise device of FIG. 1 with the platform removed.

As shown in cross-section in FIG. 1, the base 12 is preferably manufactured from molded plastic and has a ground-engaging bottom surface 16 and top surface 18 having a concave surface 20 therein. The base 12 further comprises at least one notch 22 located along the concave surface 20 for supporting at least one roller bearing 24 that extends above the concave surface 20. As shown in FIG. 5, the first embodiment of the present invention preferably includes three notches 22 located along the concave surface 20 for supporting three equally spaced roller bearings 24, each separated by 120°. The concave surface 20 and the roller bearings 24 each support the platform 14 as described in greater detail below to assist in permitting rotatable tiltable motion of the platform 14 relative to the base 12.

Figure 2:
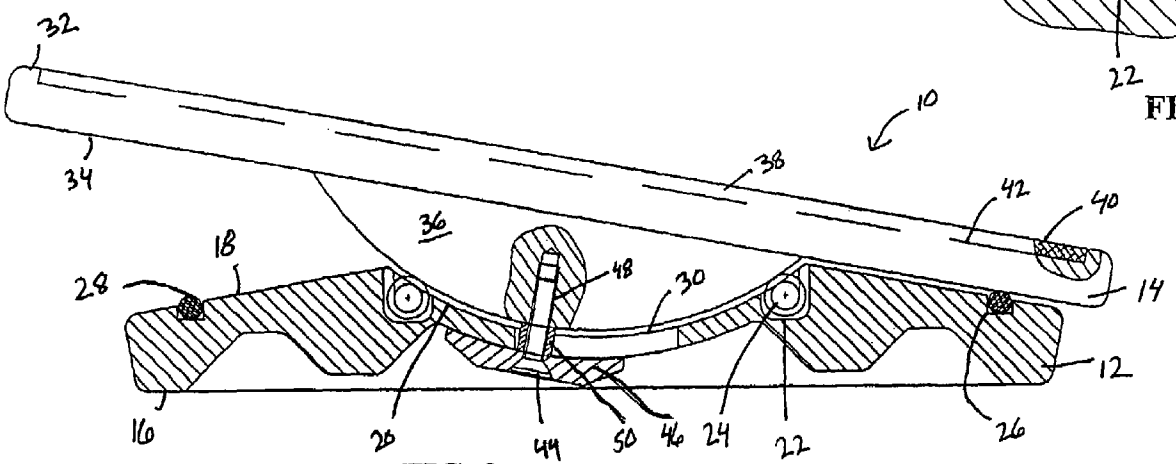
FIG. 2 is a cross-sectional view of the exercise device of FIG. 1 where the platform is fully tilted relative to the base.
Figure 3:
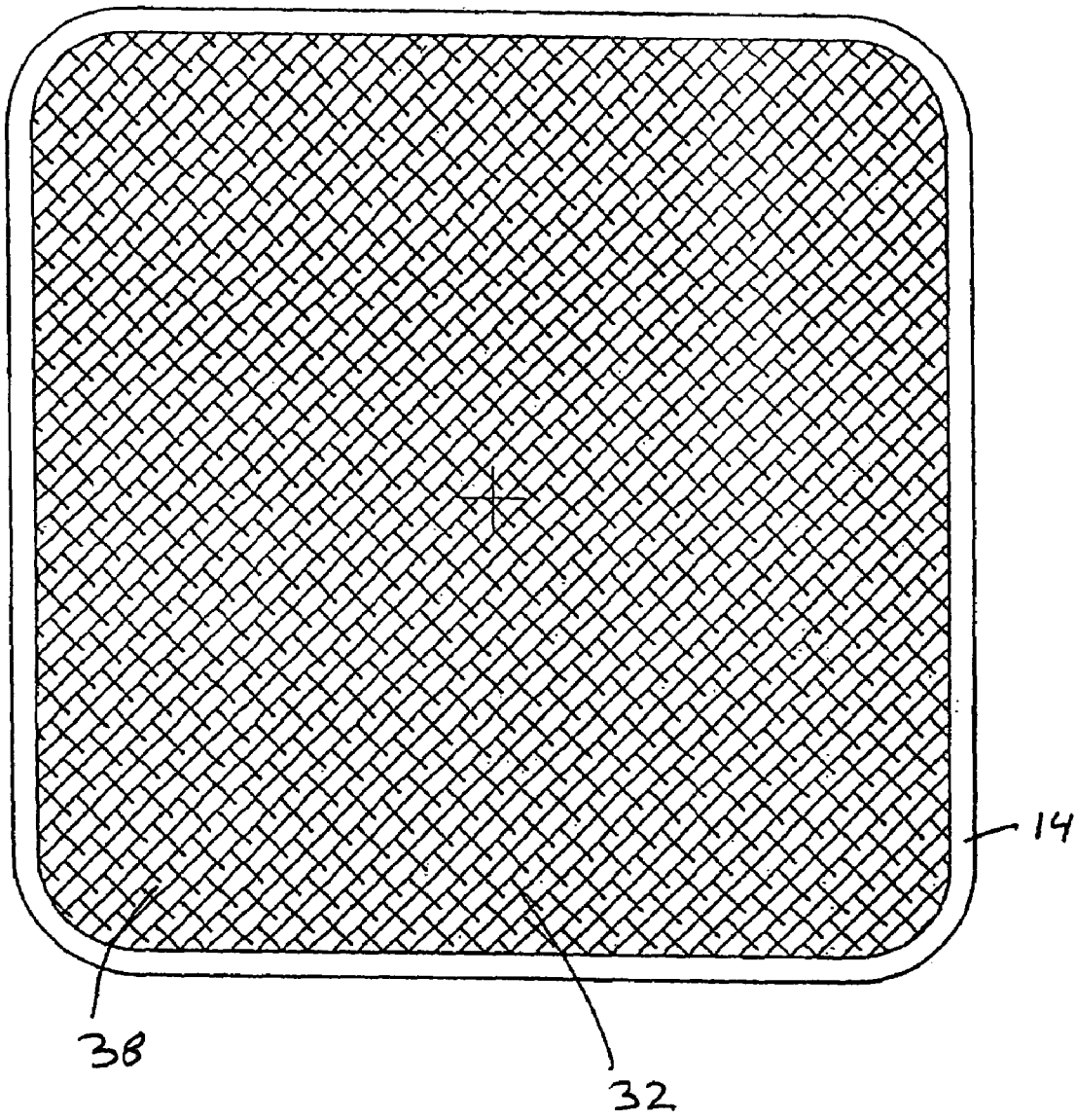
FIG. 3 is a top plan view of the exercise device shown in FIG. 1.
Figure 4:
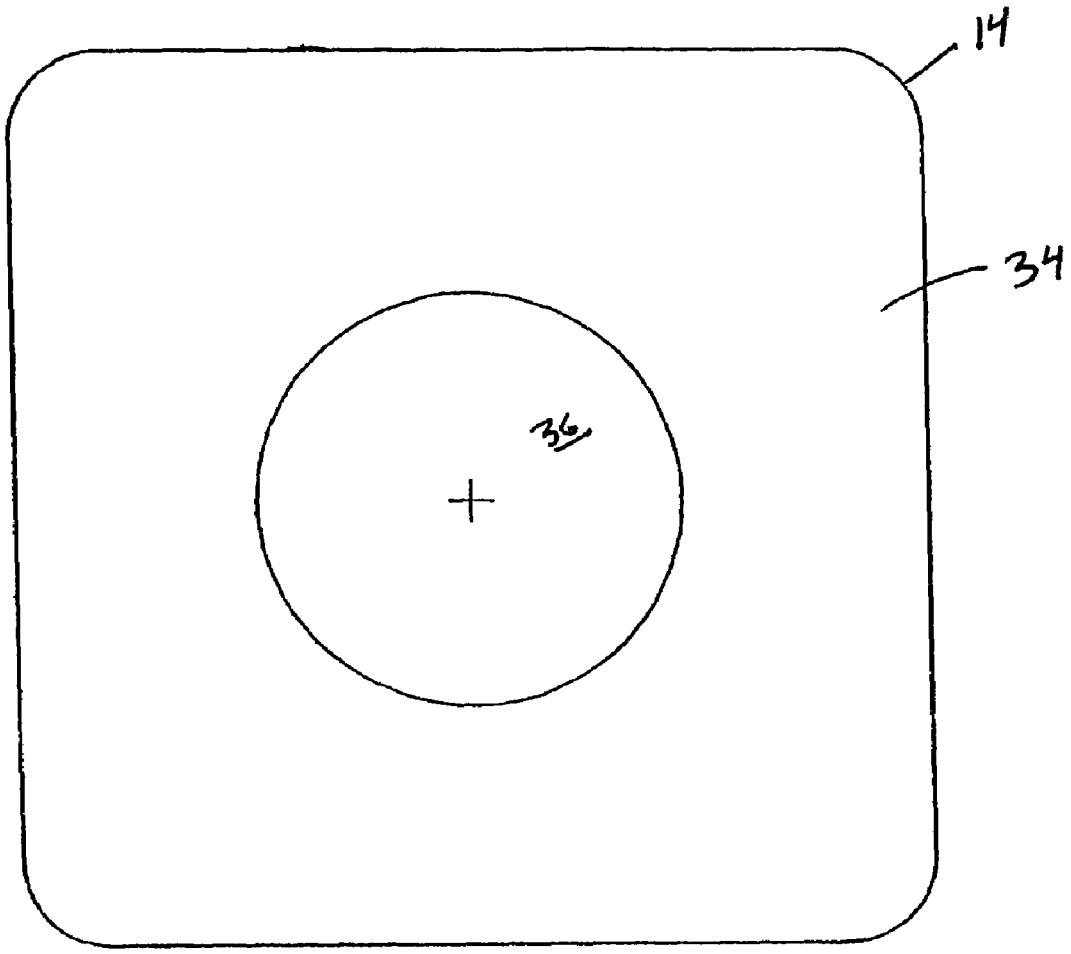
FIG. 4 is a bottom plan view of the underside of the platform of FIG. 3.

As shown in FIGS. 1 and 2, the top surface 18 also includes an annular peripheral notch 26 that houses a circular elastomeric gasket 28 which prevents rubbing and wear of the lower surface of the platform 14 against the top surface 18 of the base 12. The base 12 also includes an aperture 30 located centrally and within the concave surface 20 and extending through the base 12. The aperture 30 is utilized in connecting the platform 14 to the base 12 as further described below. As should be evident, the base 12 could comprise any configuration suitable to support the rotatably tiltable platform 14, and is preferably circular in shape.

As also shown in FIGS. 1 and 2, the platform 14 comprises a generally square body having a foot engaging top surface 32 and a bottom surface 34 having a convex surface 36 extending therefrom. The platform 14 is likewise preferably manufactured from molded plastic, although other suitable materials may also be used. The foot-engaging top surface 32 includes a traction control surface 38. And while the traction control surface 38 can utilize numerous constructions or configurations, the first embodiment preferably utilizes a rubber sheet 40 adhered within a like-shaped recessed surface 42 located in the top surface 32.

The convex surface 36 of the platform 14 nests within the concave surface 20 of the base 12 and is supported therein by roller bearings 24. The convex surface 36 of the platform 14 therefore contacts the roller bearings 24 for assistance in permitting the rotatable tiltable motion of the platform 14 relative to the base 12. And as best shown in FIG. 1, the platform 14 is mounted to the base 12 by a threaded screw 44. The threaded screw 44 engages a retainer ring 46 on the underside of the base 12. The retainer ring 46 has a greater surface area than the aperture 30 and therefore holds the platform 14 in place relative to the base 12 during use. The threaded screw 44 passes through the aperture 30 and is threadedly received within an aperture 48 in the convex surface 36 of the platform 14. A bushing 50 is provided between the retainer ring 46 and the convex surface 36 to prevent over-tightening and to protect the periphery of the aperture 30 from damage by the threaded screw 44 throughout continued use of the device 10.

Given the construction of the first embodiment of the present invention, movement of the platform 14 is not physically limited to rotatably tiltable movement. While the main function of the platform 14 is to permit rotatably tiltable movement of the platform relative to the base as described above, the platform may also be rotated about a vertical axis Z or translated from any tilted position to another as the user force requires. However, the foot-engaging top surface 32 is preferably adapted to tilt between plus or minus 12 degrees from the horizontal. Therefore, when the platform moves cyclically, the user's foot, ankle, and legs are exercised so as to increase blood circulation therein.

The exercise device according to a second embodiment of the present invention is shown in FIGS. 7 through 12. The continuous active motion exercise device, designated 100, generally comprises a base 112, a platform 114 rotatably tiltably connected to the base 112, and an electric motor 115 housed within the base 112 for driving the platform 114 for continuous active motion relative to the base 112 during activation. Continuous active motion as used in this description is described as motion of the platform attributed to forces exerted thereon by a motor or other force-producing device.

Figure 7:
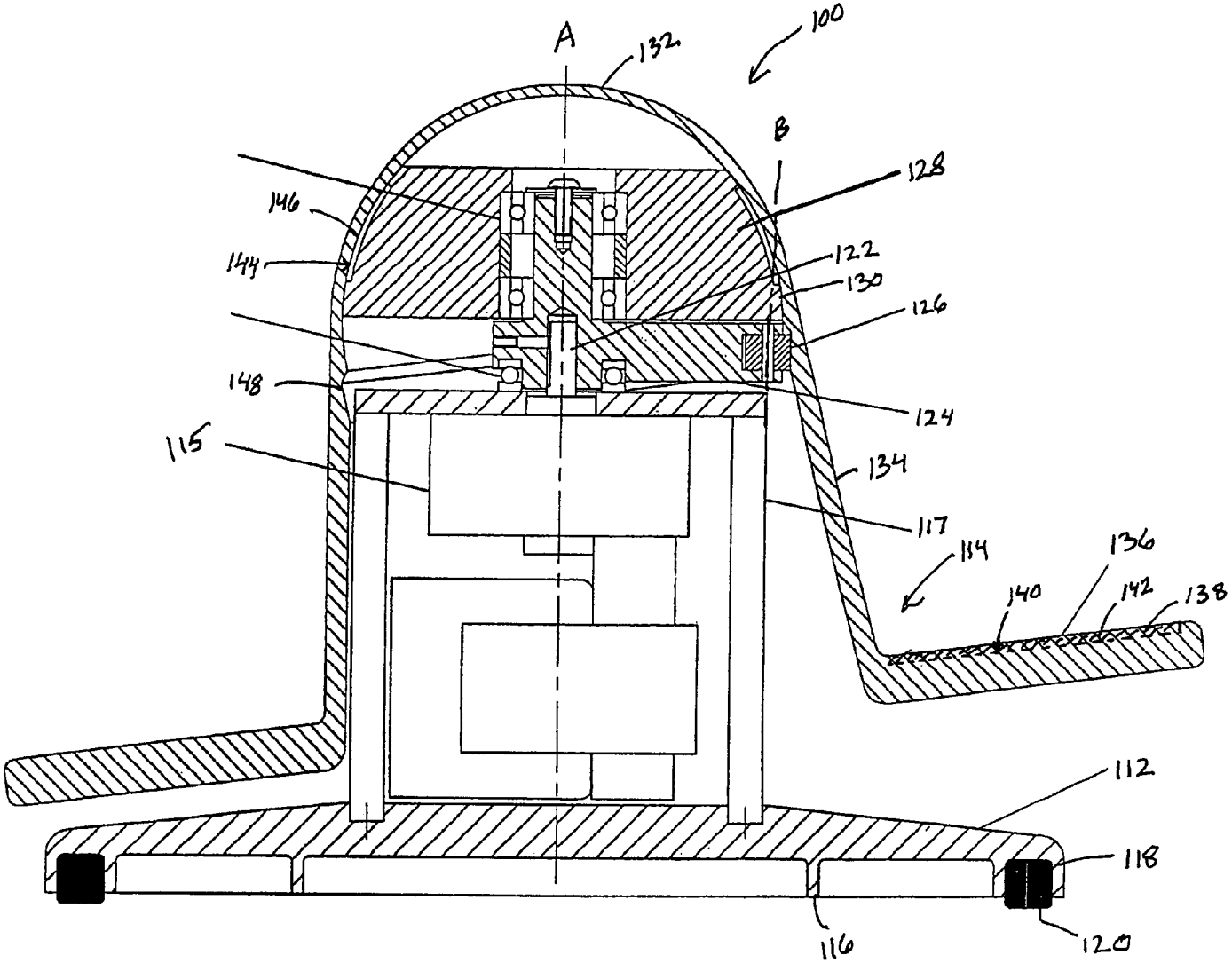
FIG. 7 is a cross-sectional view a second embodiment of the present invention showing an exercise device for continuous active motion.
Figure 9:
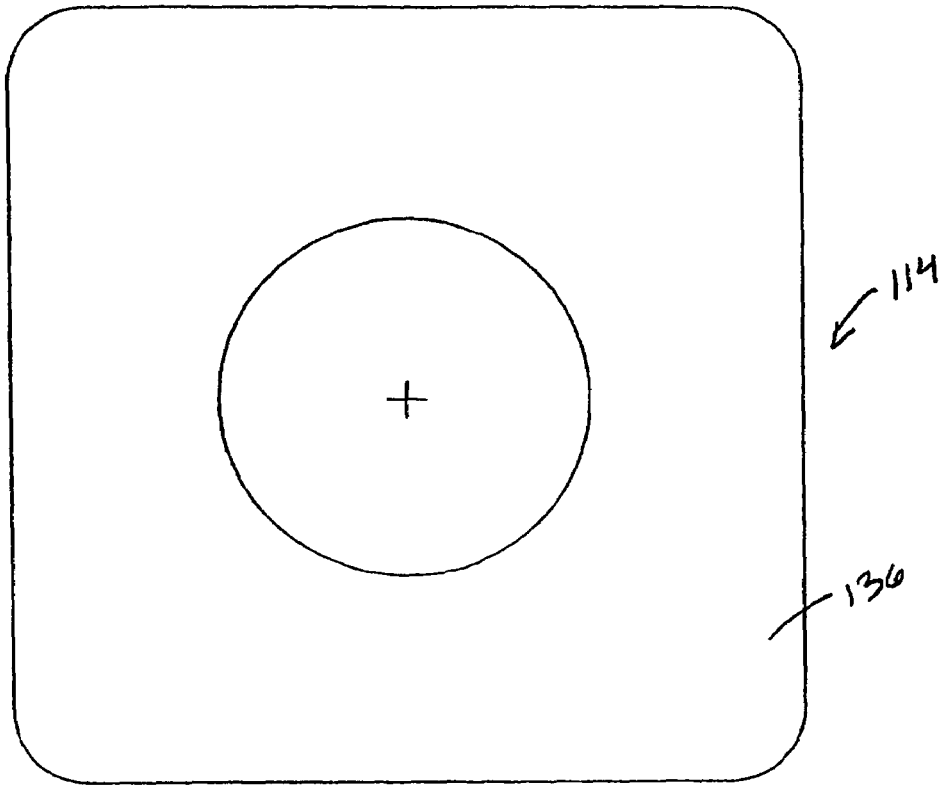
FIG. 9 is a top plan view of the platform of FIG. 8.

As shown in cross-section in FIG. 7, the base 112 is preferably made from molded plastic and has a ground-engaging bottom surface 116 and an upwardly extending body portion 117 for housing the motor 115. The base 112 further comprises an annular notch 118 located in the bottom surface 116 to house a circular elastomeric gasket 120 so as to provide stability to the base 112 during operation of the device 100. As should be evident, the base 112 could comprise any configuration suitable to support the rotatably tiltable platform 114, and is preferable circular in shape.

Motor drive shaft 122 extends upwardly from the body portion 117 and is connected to a horizontal drive arm 124 rotatable about a vertical axis A. A roller cam 126 rotatable about a vertical axis B is connected to the end of arm 124 so as to engage and drive the platform 114 as discussed below. Support member 128 is connected to the base 112 at a distance above the body portion 117 wherein the arm 124 and cam 126 are horizontally rotated and driven therebetween. The support member 128 comprises a convex outer surface 130 or portion thereof so as to provide support for the nested engagement of the platform 114 on the base 112. The support member 128 does not rotate and includes bearings therein to support the drive shaft 122.

Figure 8:
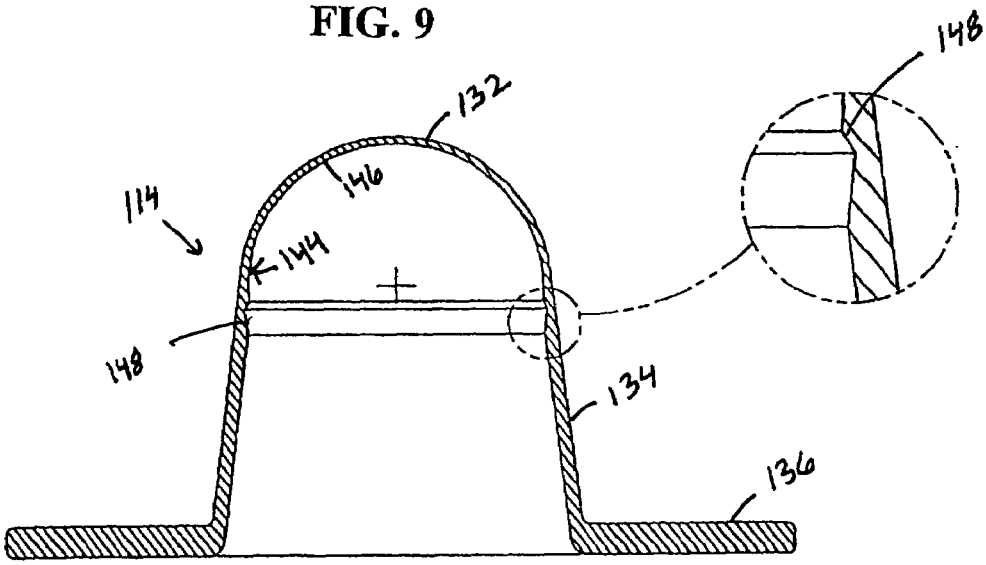
FIG. 8 is a cross-sectional view of the platform of FIG. 7.

As shown in FIGS. 7 and 8, the platform 114 comprises a top wall 132, side walls 134 extending downwardly from the top wall 132, and a foot engaging portion 136 extending radially outwardly from the lower portion of the side walls 134. The platform 114 is likewise preferably manufactured from molded plastic, although other suitable materials may also be used. The foot-engaging portion 136 is preferably square in configuration. The foot-engaging portion 136 includes a top surface 138 that includes a traction control surface 140. While the traction control surface 140 can utilize numerous constructions or configurations, the second embodiment preferably utilizes a rubber sheet 142 adhered within a like-shaped recessed surface located in the top surface 138.

An engagement surface 144 of the platform 114 is defined by the inner surface 146 of the top wall 132 and the sidewalls 134 and rests over the upwardly extending body portion 117 of the base 112. And while numerous configurations could be utilized for interaction between the support member 128 and the engagement surface 144, the outer surface of the support member 128 is preferably convex in shape and the inner surface of the top wall 132 is preferably concave in shape so as to nestedly rest upon support member 128. Therefore, during rotatably tiltable motion of the platform 114, the platform 114 can easily move relative to the support member 128.

In order to provide the required rotatably tiltable motion to the platform 114, the inner surface 146 includes an annular groove 148 engagable by cam 126. Therefore, when the motor 115 is activated and the arm 124 is rotated about vertical axis A, the cam 126 imparts a force within groove 148 that causes the platform to rotatably tilt relative to the base 112. The foot-engaging portion 136 is preferably adapted to tilt between plus or minus 12 degrees from the horizontal during use. Therefore, when the board moves cyclically, the user's foot, ankle, and legs are exercised so as to increase blood circulation therein.

As shown in FIG. 8, the groove 148 is located along a horizontal plane of the platform 114 and is configured to properly receive cam 126 when mounted at an angle to the base 112. As best shown in FIG. 7, the platform 114 is mounted to the base 112 at an angle and therefore the groove 148 is disposed at an angle relative to the base 112. Therefore, during driving engagement of the arm 124 and cam 126, the cam 126 engages the groove 148 as rotated through 360° and causes the platform 114 to rotatably tilt relative to the base 112. However, it is also possible to provide a groove having a different configuration and a platform not mounted at an angle to the base to provide the appropriate rotatable tiltable motion to the platform required by the present invention.

Figure 12:
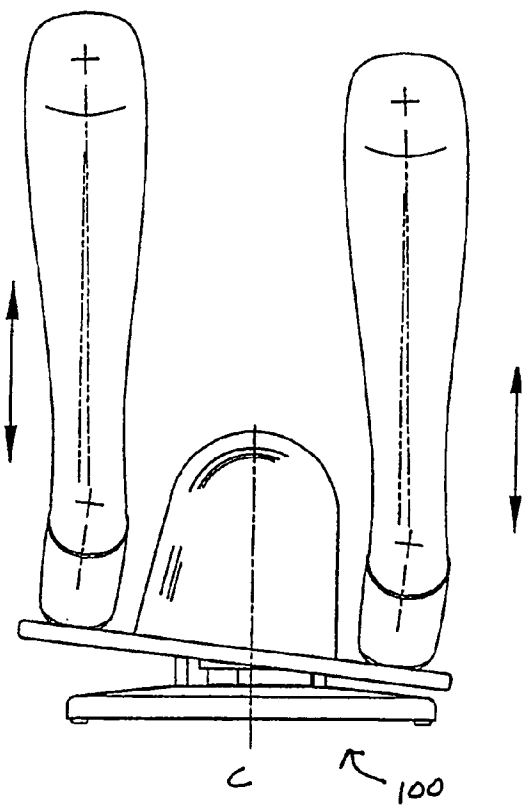
FIGS. 10 through 12 show the exercise device of FIG. 7 in a left tilting position, a rear tilting position, and a right tilting position respectively.
Figure 11:
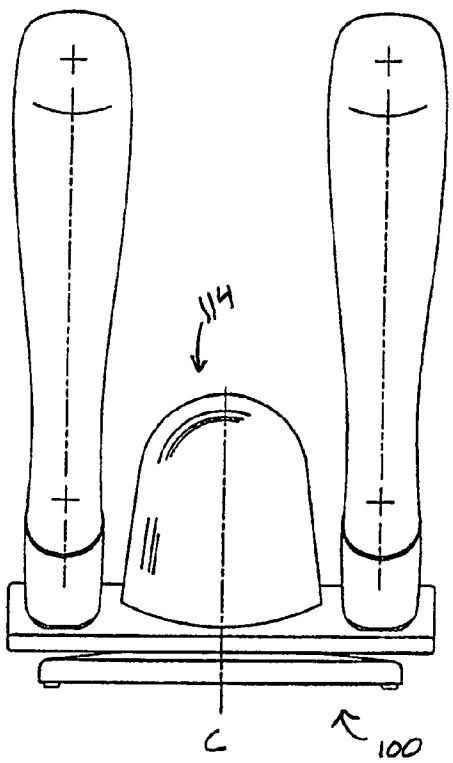
Figure 10:
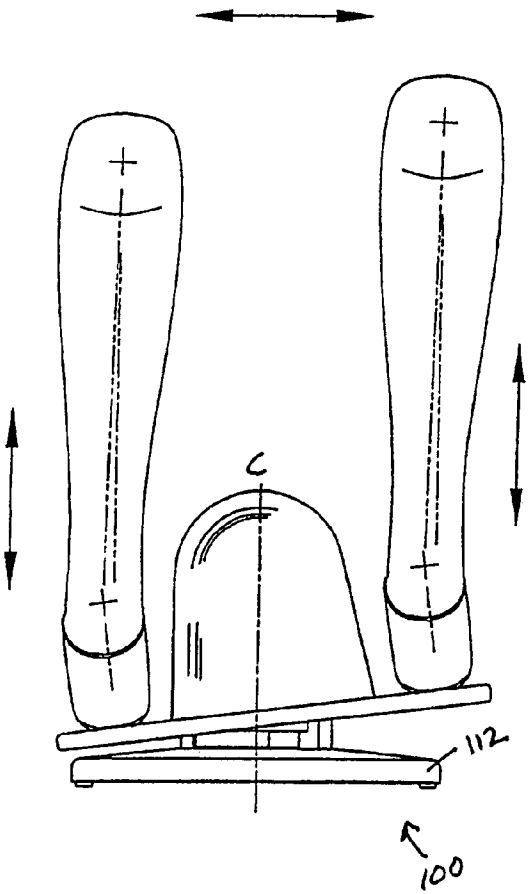
Figure 13:
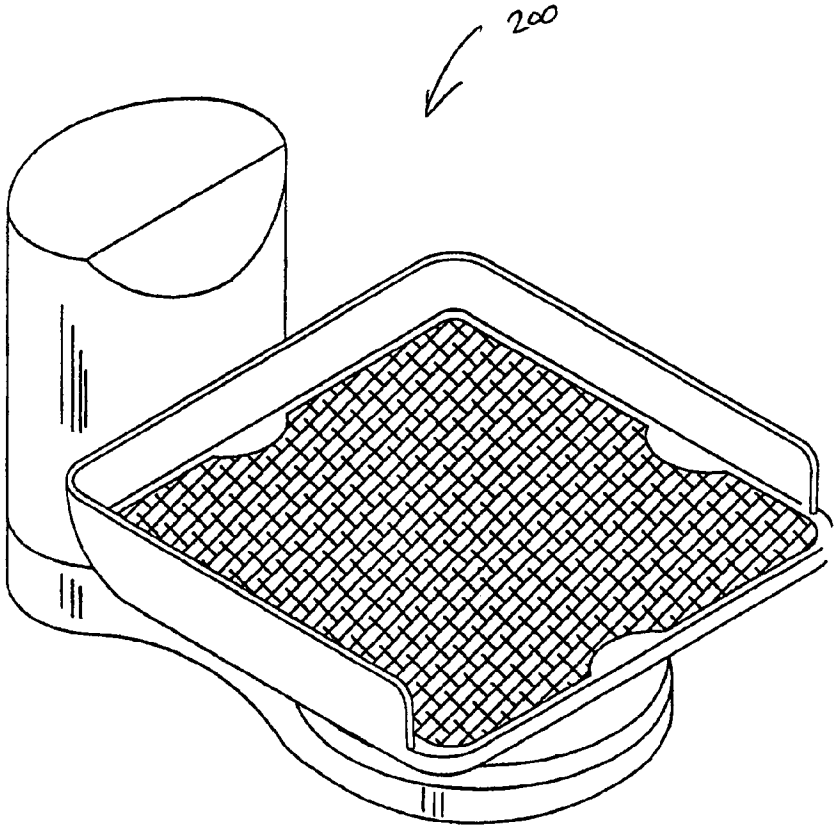
FIG. 13 is a perspective view a third embodiment of the present invention showing an exercise device for continuous active motion.
Figure 14:
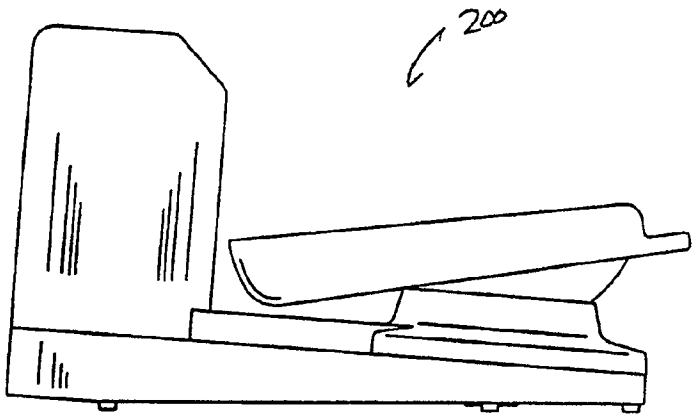
FIG. 14 is a left side elevational view of the exercise device of FIG. 13 showing the platform in a frontward tilting position.
Figure 15:
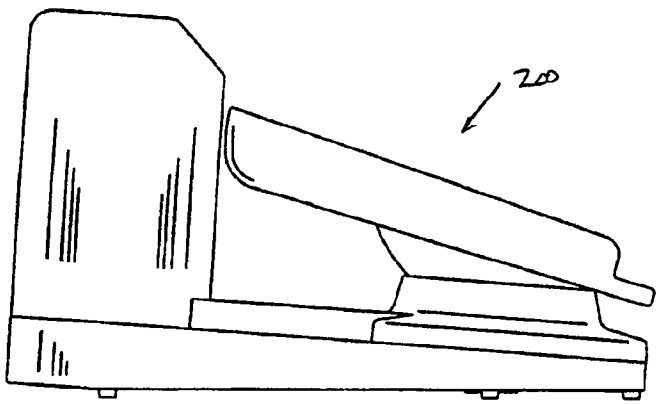
FIG. 15 is a left side elevational view of the exercise device of FIG. 13 showing the platform in a rearward tilting position.
Figure 16:
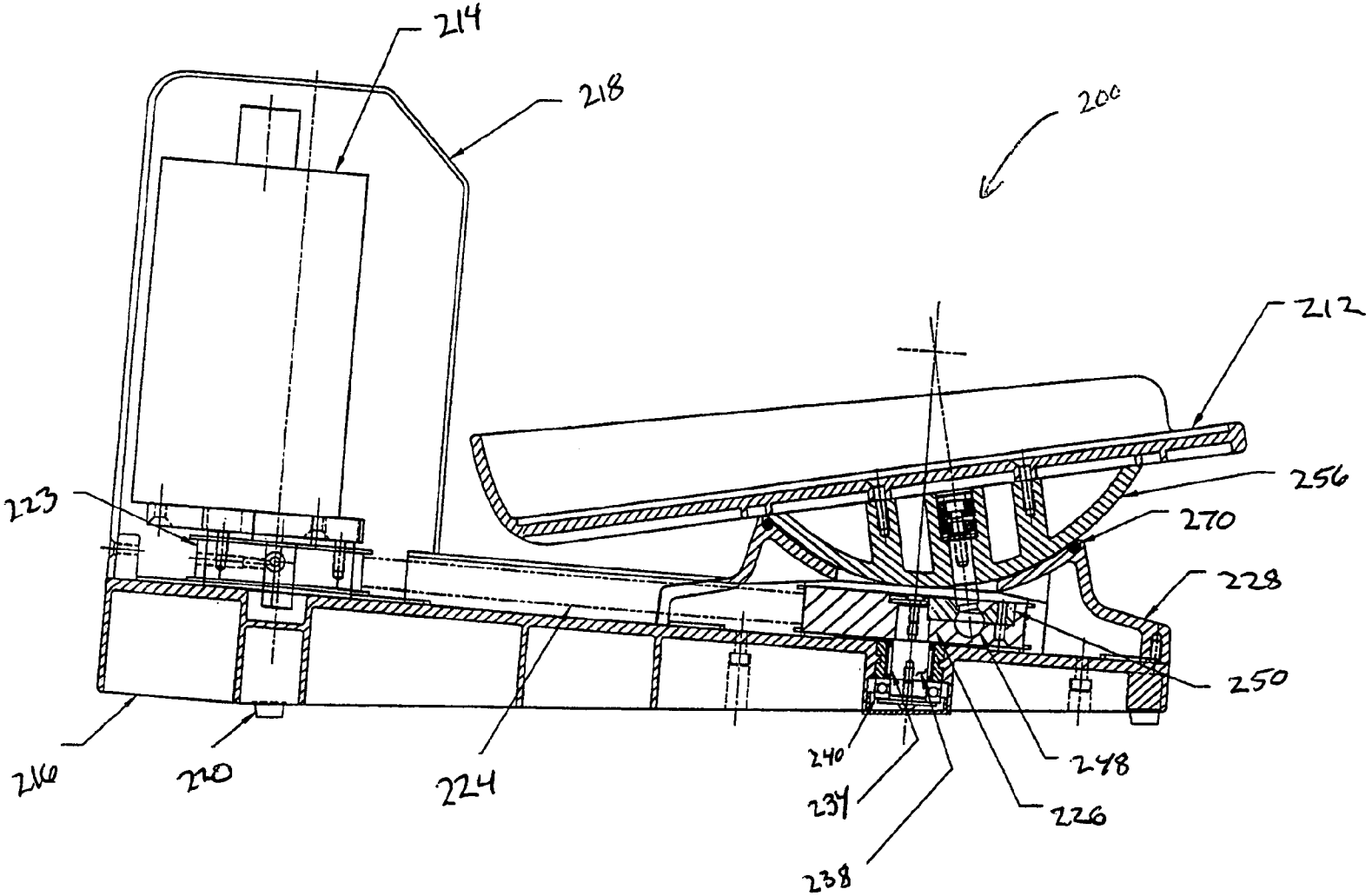
FIG. 16 is a cross-sectional view of the exercise device shown in FIG. 14.

As indicated above, the rotatably tiltable movement of the platform 114 does not permit the rotation of the platform 114 itself about a vertical axis, but the ability to tilt the platform 114 relative to the base 112 continuously throughout 360° of a common vertical axis C. As shown in FIGS. 10 through 12, the exercise device 100 of the second embodiment is shown in a left tilting position (FIG. 10), a rear tilting position (FIG. 11), and a right tilting position (FIG. 12). And under the continuous active motion imparted by the motor 115, the platform 114 is continuously tilted through the transitions shown in FIGS. 11 through 12 and in all other tiltable positions not shown.

Figure 17:
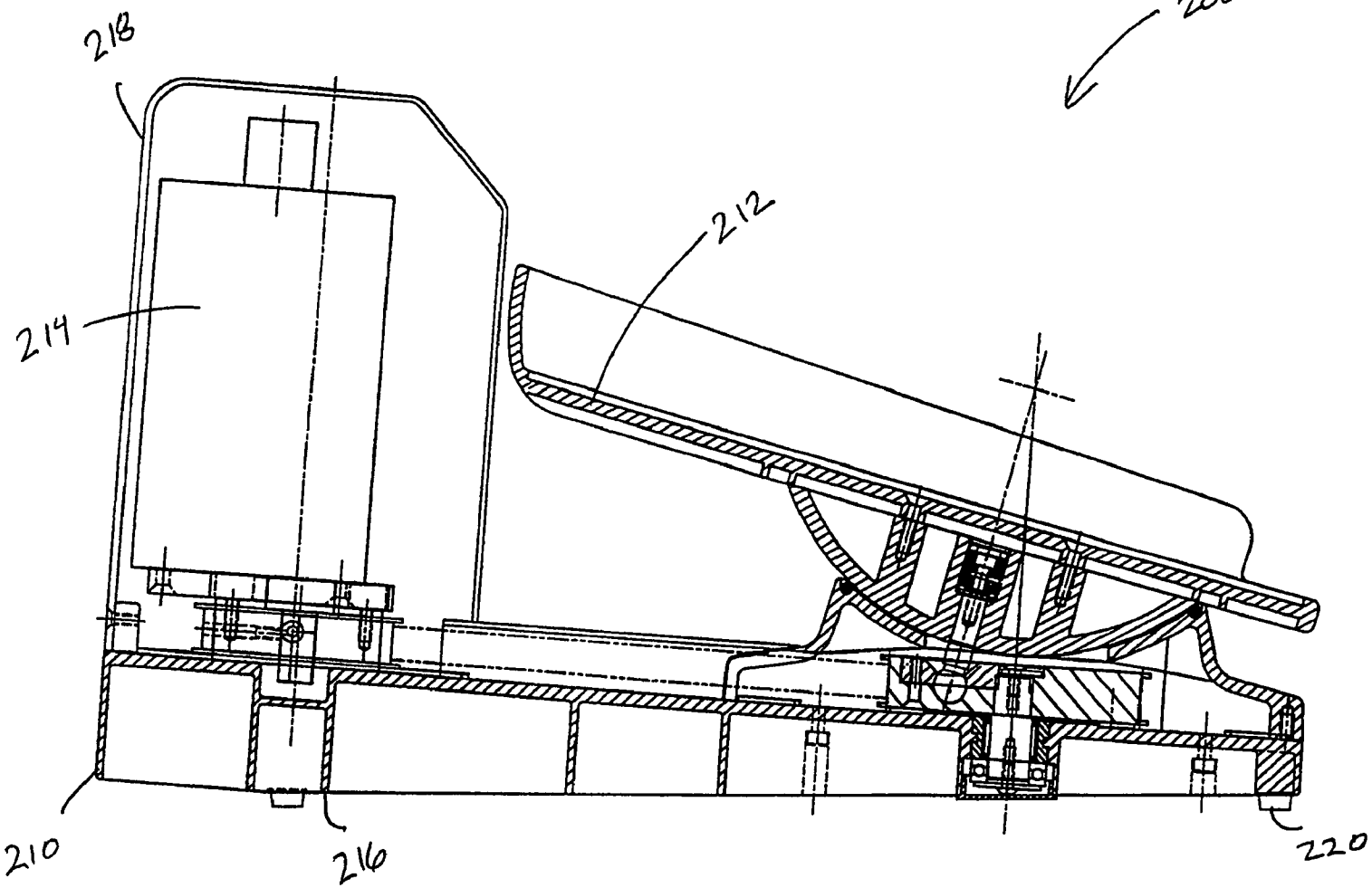
FIG. 17 is a cross-sectional view of the exercise device shown in FIG. 15.
Figure 18:
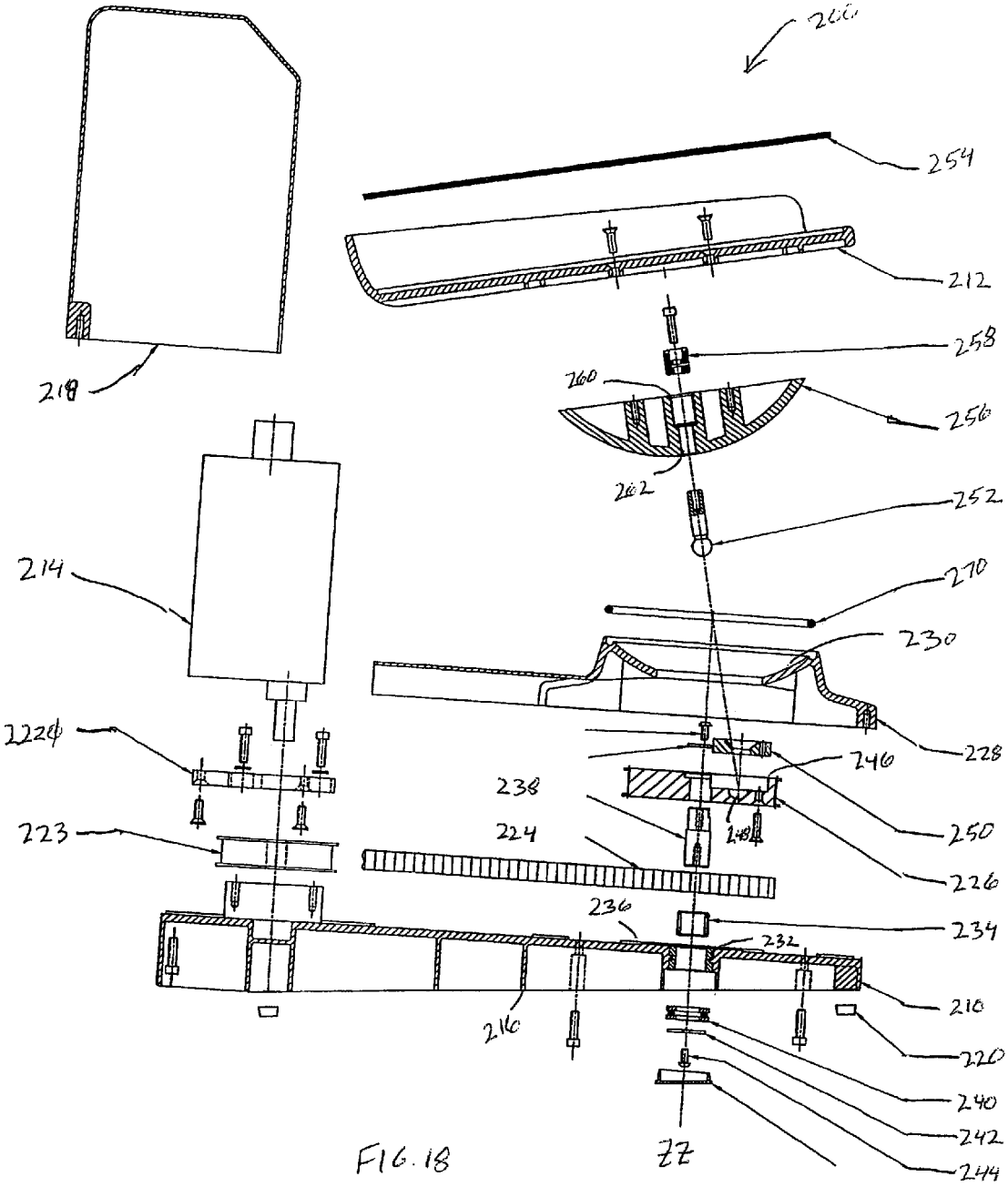
FIG. 18 is an exploded, cross-sectional view of the device shown in FIG. 16.
Figure 20:
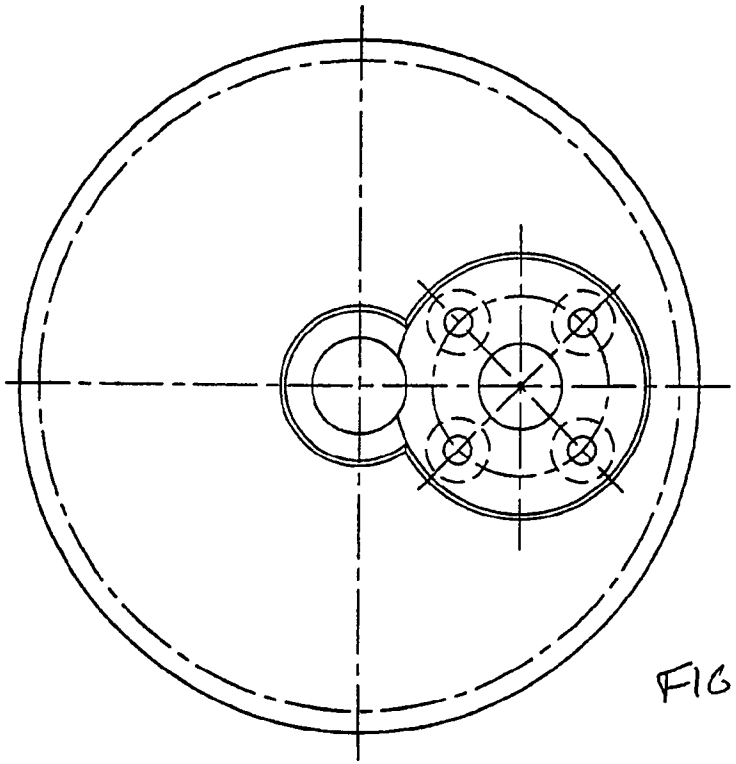
FIG. 20 is a top plan view of the driven pulley of FIG. 19.
Figure 19:
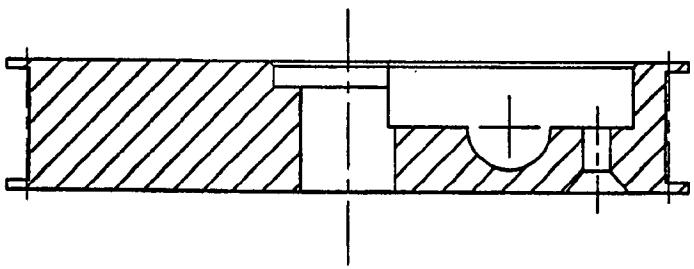
FIG. 19 is a cross-sectional side view of the driven pulley of the third embodiment.

The exercise device according to a third embodiment, and the preferred embodiment, is shown in FIGS. 13 through 21. As best shown in FIG. 17, the continuous active motion exercise device, designated 200, generally comprises a base 210, a platform 212 rotatably tiltably connected to the base 210, and an electric motor 214 housed within the base 210 for driving the platform 212 for continuous active motion relative to the base 210 during activation.

With continued references to FIG. 17, the base 210 is preferably made from molded plastic and has a ground-engaging bottom surface 216 and an upwardly extending body portion for housing the motor 214. The base 210 further comprises rubber feet 220 attached to the bottom surface 216 so as to provide stability to the base 210 during operation of the device 200. As should be evident, the base 210 could comprise any configuration suitable to support the rotatably tiltable platform 212.

The base 210 is inclined approximately 4° from the horizontal so that the platform 212 may be more easily accessed by a person in a seated position. With the base 210 supported at an angle, the user can place their feet on the footboard at an angle to the horizontal and account for and prevent over extension of the ankles. The upstanding portion of the base 210 comprises a gear motor cover 218 that houses the motor 214. Motor 214 is connected to the gear motor cover 218 by mounting plate 222. Preferably, the motor 214 can be adjustably mounted within the gear motor cover 218 through the mounting plate 222. A drive pulley 223 is connected to the gear motor 214 and drives a driven pulley 226 through connection of a drive belt 224. Driven pulley 226 drives the platform 212 for rotatably tiltable motion relative to the base 210.

Base 210 further includes a base cover 228 that houses the mechanism for providing movement to the platform 212. Base cover 228 generally comprises a body having an upstanding portion which includes a concave portion 230 that engages a nestedly received convex portion or spherical platform from the platform 212. The upstanding portion of the base cover 228 is provided so as to allow the platform 212 to tilt approximately plus or minus 12° from the horizontal. The upstanding portion of the base cover 228 also curves upwardly so as to provide clearance between the tilted platform and the base to prevent pinching the fingers of a user attempting to pick up an operating device 200 by the platform 212.

The driven pulley assembly located in the base 210 includes a bearing 232 mounted in the base 210 for receiving a needle bearing 234. The driven pulley 226 is then mounted over a bearing surface 236 that reduces friction between the driven pulley 226 and the base 210. The driven pulley 226 is rotatably connected to the base 210 by a shaft 238. A thrust bearing 240 and washer 242 are inserted below bearing 232 and a screw 244 threadedly engages shaft 238 to provide the assembly of the driven pulley 226. Therefore, torque applied to the timing belt 224 by the motor 214 provides rotational movement to the driven pulley 226.

The driven pulley 226 includes an offset recess 246 having a ball pocket 248. The ball pocket 248 receives the ball joint of the platform 212. Ball joint holder 250 is mounted to the driven pulley 226 within recess 246 and over the ball joint pocket 248 so as to capture and hold the ball joint 252 relative to the driven pulley 226.

The platform 212 comprises a generally planar surface for placing ones feet during operation of the device 200. The platform 212 may further include three upstanding wall sections to provide further support and prevent objects or articles from hanging over the platform 212. Platform 212 further includes a rubber sheet 254 for providing traction. A convex portion or spherical platform 256 is mounted to the underside of the platform 212 in an offset position. Such an offset position permits the platform 212 to rotatably tilt in a manner more beneficial to the ankle, feet, and legs. In the offset position show in the drawings, the front portion of the platform can travel a vertical distance of approximately 3 inches while the rear portion of the platform can travel a vertical distance of approximately 2 inches. This permits proper flexing of the foot and prevents over-flexing. The present invention accounts for the fact that the human ankle is not in the center of the foot but in fact is located approximately ⅓ of the length of the foot from the rear. The spherical platform 256 engages the concave portion 230 of the base cover 228 so as to permit tiltable rotation of the platform 212 relative to the base 210.

Figure 21:
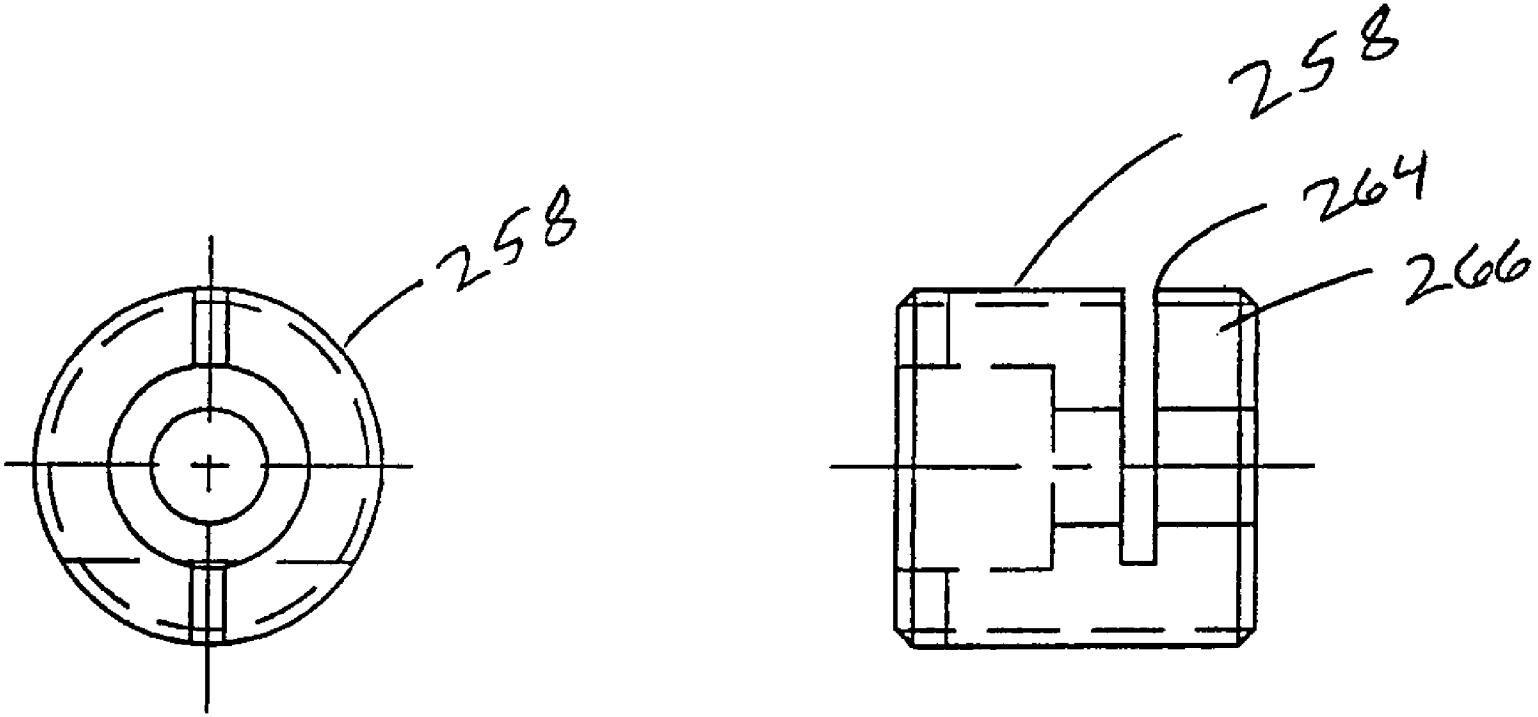
FIG. 21 is a front and side view of a retainer plug.

The ball joint 252 is connected to the spherical platform 256 through the use of a novel retaining plug 258. Retaining plug 258 is inserted into an oversized bore 260 in the spherical platform 256 and receives the shaft of the ball joint 252 through an aligned through bore 262 in the spherical platform 256. A screw is inserted through a bore of the retaining plug 258 and threadedly engages the ball joint 252 so as to tighten the connection and provide a means for adjusting the length of the ball joint 252 relative to the spherical platform 256. As best seen in FIG. 21, the retaining plug 258 includes notch 264 that upon tightening of screw deforms lip portion 266 so as to bind the screw and prevent loosening.

It should be appreciated that the engagement of the platform 212 to the base 210 through the ball joint 252 is an adjustable connection. The ball joint 252 can be preliminarily set within the spherical platform by the screw and retaining plug but not fully tightened. The ball joint can then be placed within the ball pocket 248 of the driven pulley 226 and set by the ball joint holder 250. Then screw can then be tightened to ball joint 252 so as to tighten the connection between the platform 212 and the base 210 and so as to provide the proper length of the ball joint shaft for optimal pivotal engagement of the platform 212 to the base 210.

Once the platform 212 is connected to the base 210 as indicated above, the spherical platform 256 will rotatably tilt within the concave portion 230 of the base cover 228 thereby providing rotatably tiltable motion to the platform 212. A bearing ring 270, preferably made of bronze, is held within an annular groove in the concave surface 230 to assist the ease of movement of the spherical platform 256. The bearing ring 270 may also be greased to reduce the friction and wear on the spherical platform 256.

In operation, a user places their feet on the platform and activates control switches on the gear motor cover 218 (not shown) which include an on/off switch and a potentiometer for controlling the speed of platform movement and the direction of tiltable rotation. The device may further utilize a remote control device to turn the device on or off and control the potentiometer. During activation, the motor 214 rotates the drive pulley 223 that imparts rotational movement to the drive pulley 226 through belt drive 224. As the driven pulley 226 rotates, the ball joint 252 mounted in the offset ball pocket 248 is forced to rotate about the axis of the driven pulley ZZ. Such rotation imparts a rotation to the tilted platform 212 so as to provide continuous rotatably tiltable motion to the platform. Most advantageously, because the spherical platform 256 is offset from the platform 212, the center of rotation of the platform 212 is aligned with the ankles of the foot so as to prevent overstretching. Further, because the center of rotation of the platform is offset, the leg weight placed on the device 200 is transferred through the pivot center. Through this construction, the device 200 can support additional weight while allowing the motor 214 to be of reduced strength. Further, reduced momentums allow smaller pivot components and reduces the energy required to move the pivot. Therefore, although devices similar to the present invention will typically utilize a 0.5 horsepower motor, the present invention has a construction that permits the use of a 1/16 horsepower motor.

The invention has been described with reference to the preferred embodiment and a second embodiment. Obviously, modifications and alternations will occur to others upon a reading and understanding of this specification. The claims as follows are intended to include all modifications and alterations insofar as they come within the scope of the claims or the equivalent thereof.

Having thus described the invention, we claim:

1. An exercise device comprising:

a base having a ground-engaging bottom surface and top surface having a concave surface therein;

a platform having a substantially flat, foot engaging top surface and a bottom surface having a convex surface extending therefrom;

wherein said convex surface nests within said concave surface permitting said platform to be rotatably tiltable relative to said base.

2. The exercise device of claim 1 wherein said platform is rotatably tiltable to said base for continuous passive motion.

3. The exercise device of claim 2 further comprising at least one roller bearing located within said base and extending beyond said concave surface into contact with said convex surface to assist in permitting the rotatable tiltable motion of said platform relative to said base.

4. The exercise device of claim 3 having three roller bearings located within said base and located approximately 120° apart.

5. An exercise device comprising:

a base having an upwardly facing concave surface;

a platform rotatably tiltably connected to said base, said platform comprising:

a substantially flat, foot engaging top surface; and a downwardly facing convex surface, wherein said convex surface nests within said concave surface permitting said platform to be rotatably tiltable relative to said base; and a motor housed within said base, said motor driving said platform for continuous active motion relative to said base during activation.

6. The exercise device of claim 5 wherein said downwardly facing convex surface is offset from the center of said platform.

7. The exercise device of claim 6 further comprising a ball joint extending from said convex surface, said concave surface having an aperture therein providing access to the interior of said base through which the ball joint extends, and a driven pulley mounted within said base and having an offset ball pocket therein for receivably mounting said ball joint so that rotation of said driven pulley imparts rotatably tiltable motion to said platform.

8. The exercise device of claim 7 wherein said driven pulley is driven by a timing belt connected to said motor.

9. The exercise device of claim 8 wherein the length of said ball joint is adjustable relative to said convex surface.

10. The exercise device of claim 9 wherein said base is manufactured from molded plastic.

11. The exercise device of claim 9 wherein said platform is manufacture from molded plastic.

* * * * *